US006709711B1

(12) United States Patent
Wydra et al.

(10) Patent No.: US 6,709,711 B1
(45) Date of Patent: Mar. 23, 2004

(54) METHOD FOR PRODUCING AN ADHESIVE LAYER FOR A HEAT INSULATING LAYER

(75) Inventors: Gerhard Wydra, Oberschleissheim (DE); Martin Thoma, Munich (DE); Horst Pillhoefer, Roehrmoos (DE)

(73) Assignee: MTU Motoren-und Turbinen-Union München GmbH, München (DE)

( * ) Notice: Subject to any disclaimer, the term of this patent is extended or adjusted under 35 U.S.C. 154(b) by 0 days.

(21) Appl. No.: 09/485,082

(22) PCT Filed: May 31, 1999

(86) PCT No.: PCT/DE99/01598

§ 371 (c)(1),
(2), (4) Date: Apr. 19, 2000

(87) PCT Pub. No.: WO99/63126

PCT Pub. Date: Dec. 9, 1999

(30) Foreign Application Priority Data

Jun. 3, 1998 (DE) ..... 198 24 792

(51) Int. Cl.[7] ..... B05D 1/36; B05D 3/02; B05D 1/02; B05D 1/18; B05D 1/28

(52) U.S. Cl. ..... 427/405; 427/376.4; 427/383.1; 427/383.3; 427/383.7; 427/427; 427/429; 427/436; 427/443.2

(58) Field of Search ..... 427/207.1, 376.4, 427/383.1, 383.3, 383.7, 405, 427, 429, 436, 443.2

(56) References Cited

U.S. PATENT DOCUMENTS 3,720,537 A * 3/1973 Rigney ..... 117/50
4,009,146 A 2/1977 Cork et al.
4,241,113 A 12/1980 Martinengo et al.
4,910,092 A * 3/1990 Olson et al. ..... 428/557
5,759,142 A * 6/1998 Perdikaris ..... 492/54
5,763,107 A * 6/1998 Rickerby et al. ..... 428/623

FOREIGN PATENT DOCUMENTS

| | | |
|---|---|---|
| DE | 2 043 964 | 4/1971 |
| DE | 42 26 272 | 2/1994 |
| EP | 0 048 083 | 3/1982 |
| FR | 2 244 011 | 4/1975 |
| FR | 2 397 468 | 2/1979 |
| GB | 2269393 A * | 2/1994 |

OTHER PUBLICATIONS

Abstract of Japanese Published Application 58–177401 Published Oct. 18, 1983, *Patent Abstracts of Japan*, vol. 008, No. 016(M–270) of Jan. 24, 1984.
Abstract of Japanese Published Application 60–067652 of Apr. 18, 1985, *Patent Abstracts of Japan*, vol. 009, No. 200 (C–298) of Aug. 16, 1985.

* cited by examiner

*Primary Examiner*—Michael Barr
(74) *Attorney, Agent, or Firm*—Schiff Hardin & Waite

(57) ABSTRACT

The invention is directed to a method for producing a corrosion-resistant and oxidization-resistant layer that is applied onto a component part, whereby the method can be simply and cost-beneficially implemented in fabrication-oriented terms and comprises the steps:

a) producing a slip by mixing powder containing at least one of the elements Cr, Ni or Ce with a binding agent;

b) applying the slip onto the component part;

c) drying the slip at temperatures from room temperature through 300° C.; and d) alitizing the slip layer.

17 Claims, 1 Drawing Sheet

METHOD FOR PRODUCING AN ADHESIVE LAYER FOR A HEAT INSULATING LAYER

BACKGROUND OF THE INVENTION

The invention is directed to a method for manufacturing an adhesion layer for a heat insulation layer that is applied onto a component part.

Thermally or mechanically stressed component parts are provided with protective layers, for example anti-wear layers or heat insulation layers. An adhesion layer is generally provided between such an outer layer and the component part. Such adhesion layers must comprise a certain roughness and surface topography for clamping to the outer layer.

In gas turbine engineering with, for example, highly thermally stressed, metallic component parts such as turbine blades, the adhesion layers blades are provided between the component part and a heat insulation layer. Such heat insulation layers can be composed of a basis of zirconium oxide with additives of calcium oxide or magnesium oxide. In addition to the roughness for clamping to the outer protective layer or, respectively, the heat insulation layer, the adhesion layers must be oxide free and resistant to hot-gas corrosion. Since different thermal expansions generally occur in the heat insulation layer and the material of the metallic component part, these must also be at least partially compensated by the adhesion layer.

Diffusion layers that contain Al, Cr or Si are known as adhesion layers, these being manufactured by what is referred to as a powder packing method or out-of-pack method. The disadvantage of the diffusion layers manufactured with these methods are their brittleness and the limited layer thicknesses of up to approximately 100 $\mu$m.

Another known layer, what is referred to as a seating layer, on a MCrAlY basis is sprayed onto the component part with plasma spraying or is vapor-deposited onto the component part with evaporation of the layer constituents in an electron beam. Layer thicknesses up to approximately 300 $\mu$m are thereby achieved. Such methods are extremely complicated and expensive in terms of fabrication technology. Further disadvantages are that the layers cannot be uniformly applied onto geometrically complicated component parts, scatters in the layer composition occur, and the layer elements oxidize when being sprayed on or, respectively, when being vapor-deposited.

JP 55-82761 A discloses that component parts of, for example, a gas turbine, which parts are exposed to hot gases, can be protected in that Ni powder, which is provided with a bonding agent, is first applied onto the component part and is heat-treated, Cr is then introduced by chemical vapor-phase deposition or Al is introduced by a packing method, and, finally, Pt, Pd or Rh are deposited and heat-treated.

SUMMARY OF THE INVENTION

The object of the present invention is comprised in creating a method for manufacturing a layer of the species initially described that can be manufactured optimally simply in fabrication-oriented terms and cost-beneficially.

The attainment of this object is inventively characterized by the steps:

a) producing a slip by mixing powder containing at least one of the elements Cr, Ni or Ce with a binding agent;

b) applying the slip onto the component part;

c) drying the slip at temperatures from room temperature through 300° C.; and d) alitizing or aluminizing the slip layer to form an adhesive layer, whereby the method is controlled so that the adhesion layer comprises a structure having a grain size less than 75 $\mu$m and a cavity proportion from 0 through 40%.

The advantage of the method is that the powder mixed with a binding agent can be applied onto the component part in a simple way upon formation of a layer without requiring methods such as plasma spraying or electron beam evaporation that are expensive in terms of the outlay for systems. The layers manufactured with this method have a comparatively fine-grained structure with a grain size that is smaller than 75 $\mu$m. The layer comprises a cavity proportion from 0 through 40%. As a result, the layer has an improved thermal fatigue resistance as well as an advantageous expansion behavior that is error-tolerant with respect to cracks. Moreover, additives of elements such as, for example, Y are uniformly distributed and not oxidized.

In a preferred development of the method, the slip is produced with a powder of MCrAlY or, respectively, a MCrAlY alloy, whereby M stands for at least one of the elements Ni, Co, Pt or Pd and instead of Y, Hf or Ce can also be employed.

The powder is preferably present with a grain size distribution from 5 through 120 $\mu$m.

The application of the slip onto the component part preferably ensues by spraying, brushing or immersion, as a result whereof the method can be simply and cost-beneficially implemented in terms of fabrication technology. As a result of this type of application, locally limited layers can also be applied to geometrically complicated component parts in a simple way. Moreover, no expensive and complicated spraying and evaporation systems are required. Differing from thermal spraying or electron beam vapor-deposition, moreover, the problem of oxidation of the powder particles does not occur.

The drying of the slip, which is present in a suspension together with the organic or inorganic binding agent, is preferably implemented over 0.5 through 4 hours, whereby a duration of 1 through 2 hours has proven advantageous.

It is also preferred that the slip layer is heat-treated at temperatures from 750 through 1200° C. in argon or a vacuum before the alitizing, whereby the heat treatment can be implemented over 1 through 6 hours in order to bond the slip layer to the component part by diffusion.

In a preferred development of the method, the final step of alitizing or aluminizing the slip layer is implemented at a temperature between 800 and 1200° C. and a duration of 1 through 12 hours. The aluminizing serves the purpose of diffusion joining and compacting the layer and is implemented in a standard method such as, for example, in the powder pack method upon introduction of Al. The Al diffuses into the layer and into the basic material of the component part.

The layer is also preferably an adhesion layer onto which a heat insulation layer is applied as an outer layer or, respectively, protective layer, this potentially ensuing in a standard way by plasma spraying or electron beam vapor-deposition.

The invention is explained in greater detail with reference to the drawings.

DESCRIPTION OF THE PREFERRED EMBODIMENT

In the manufacture of a layer, a MCrAlY powder is first mixed in a suspension with a standard inorganic binding agent for producing a slip. The grain sizes of the powder particles lie between 5 and 120 μm. A flowable, sprayable mass thereby forms. The viscosity of this mass can be influenced, for example, by the grain size of the powder particles employed. The M stands for nickel or cobalt or an alloy of these two elements. The proportion of aluminum and chromium is selected as high as possible in order to utilize their protective effect against oxidation, this being based thereon that chromium and aluminum form oxides serving as protective films at high temperatures.

Subsequently, the slip is applied with a brush onto a metallic component part such as a turbine guide blade composed of a nickel-based alloy upon formation of the layer. The thickness and local spread of the layer can be influenced in a simple way in this type of application. Alternatively, the application could ensue, for example, with a spray gun as well.

In the next step, the slip present in a suspension is dried at room temperature over approximately 1.5 hours.

The dried layer is then heat-treated in argon at 1000° C. for 1 hour in order to achieve a union of the layer with the material of the turbine guide blade by diffusion. Following thereupon, the layer is alitized at approximately 1100° C. for 4 hours with a standard method in order to strengthen the union with the metallic component part by diffusion and to compact the layer. Al thereby enters into the layer and into the base material of the metallic component part and sees both to a firm connection of the layer with the component part as well as to a connection of the spherical MCrAlY particles with one another. Moreover, the MCrAlY particles at least partially sinter to one another.

Figure 1:
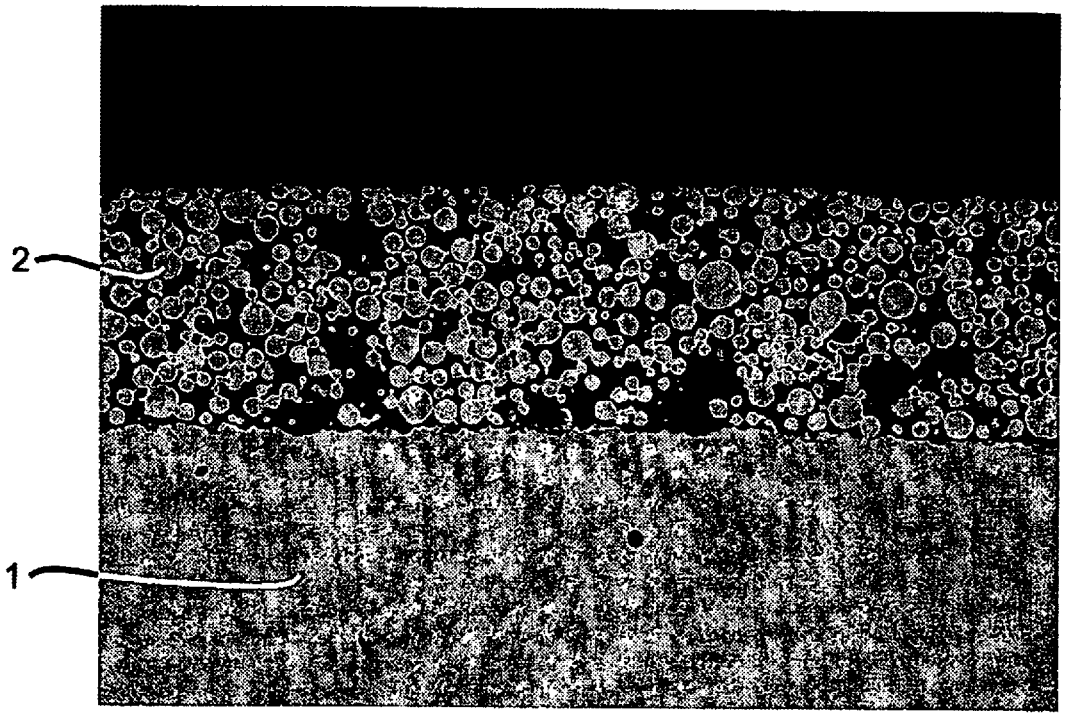
FIG. 1 is a photomicrograph of a polished section of the layer before the alitizing.

FIG. 1 shows a layer 2 applied onto a metallic component part 1 that has been heat-treated but not yet alitized. The spherical structure of the MCrAlY particles as well as the cavities located therebetween can be clearly seen in the layer 2.

Figure 2:
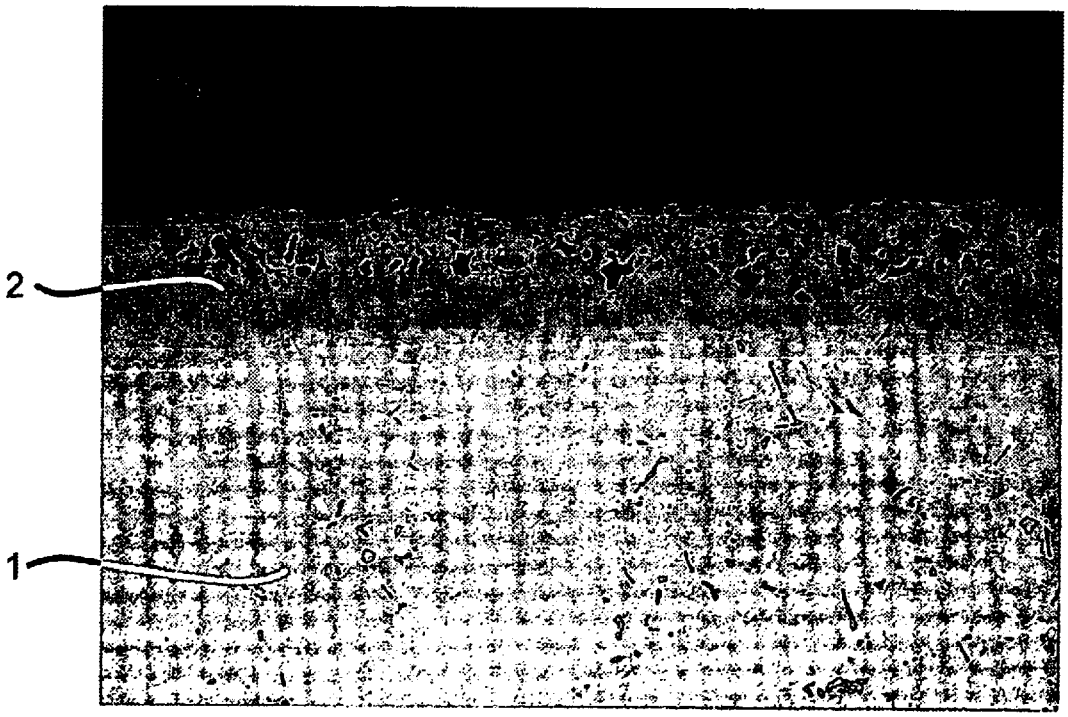
FIG. 2 is a photomicrograph of a polished section through the layer after the alitizing.

FIG. 2 shows the component part 1 and the layer 2 after the alitizing step. Noticeably fewer cavities are present in the layer 2. Moreover, the spherical MCrAlY particles are united with one another by the penetration of Al into the layer and into the base material of the component part 1. A sintering of the MCrAlY particles to one another also ensues in the alitizing step.

The layer produced in this way exhibits a clearly improved thermal fatigue resistance compared to (adhesion) layers produced in a traditional way. Moreover, no oxide formation of the layer ensues. Over and above this, the active elements such as Y are uniformly distributed and not oxidized.

The layer manufactured in this way can be utilized as an adhesion layer onto which a heat insulation layer is applied as a final step by plasma spraying or with some other standard method. The layer can also be utilized without further ado as a high-grade hot-gas corrosion layer without having to apply an additional, outer protective layer. The properties of the corrosion-resistant and oxidation-resistant layer can be varied or, respectively, improved by lengthening the alitizing process.

What is claimed is:

1. Method for manufacturing an adhesion layer for a heat insulating layer that is applied onto a component part, the method comprising the steps:

a) producing a slip by mixing powders containing Ce and at least one of the elements Cr and Ni with a binding agent;

b) applying the slip onto the component part;

c) drying the slip at temperatures from room temperature through 300° C.;

d) alitizing to cause diffusion joining and compacting of the slip layer to form the adhesion layer, whereby the method is controlled so that the adhesion layer comprises a structure having a grain size less than 75 μm and a cavity proportion from 0 through 40%; and e) applying a hear insulating layer on the adhesive layer.

2. Method according to claim 1, wherein the slip is produced with a powder of MCrAlY.

3. Method according to claim 2, wherein the powder is present with a grain size distribution from 5 through 120 μm.

4. A method according to claim 2, which includes, prior to the step of alitizing, heat treating the slip layer in a vacuum at a temperature range of 750° C. to 1200° C.

5. Method according to claim 4, wherein the heat treatment is implemented over 1 through 6 hours.

6. A method according to claim 2, wherein the step of applying is selected from a group consisting of spraying brushing and immersing.

7. A method according to claim 2, wherein the component part is composed of an alloy selected from the group consisting of nickel-based alloys and cobalt-based alloys.

8. A method according to claim 2, wherein the drying is implemented for a period of 0.5 to 4 hours.

9. A method according to claim 2, which includes, prior to the step of alitizing, heat treating the slip layer in argon at a temperature of between 750° C. to 1200° C.

10. A method according to claim 9, wherein the step of heat treating is for 1 to 6 hours.

11. A method according to claim 2, wherein the step of alitizing is implemented at a temperature between 800° C. and 1200° C. for a duration of 1 to 12 hours.

12. A method according to claim 1, wherein the powder is present with a grain size distribution of 5 μm through 120 μm.

13. A method according to claim 1, wherein the step of applying is selected from a group consisting of spraying, brushing and immersing.

14. A method according to claim 1, wherein the component put is composed of an alloy selected from a group consisting of nickel-based alloys and cobalt-based alloys.

15. A method according to claim 1, wherein the step of drying is implemented over 0.5 to 4 hours.

16. A method according to claim 1, wherein the step of alitizing is at a temperature of 800° C. through 1200° C. for a duration of 1 to 12 hours.

17. A method according to claim 1, wherein the step of applying a heat insulating layer applies a material consisting of zirconium oxide with an additive selected from a group consisting of calcium oxide and magnesium oxide.

* * * * *